US010136212B2

(12) United States Patent
Lee et al.

(10) Patent No.: US 10,136,212 B2
(45) Date of Patent: Nov. 20, 2018

(54) SPEAKER DEVICE AND AUDIO OUTPUT DEVICE INCLUDING THE SAME

(71) Applicant: SAMSUNG ELECTRONICS CO., LTD., Suwon-si, Gyeonggi-do (KR)

(72) Inventors: Ho-sun Lee, Seoul (KR); Se-june Park, Seoul (KR); Ho-jin Yoon, Yongin-si (KR)

(73) Assignee: Samsung Electronics, Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/668,843

(22) Filed: Aug. 4, 2017

(65) Prior Publication Data

US 2018/0132033 A1 May 10, 2018

(30) Foreign Application Priority Data

Nov. 4, 2016 (KR) ..... 10-2016-0146730

(51) Int. Cl.

| | |
|---|---|
| ***H04R 1/02*** | (2006.01) |
| ***H04R 9/06*** | (2006.01) |
| ***H04R 1/24*** | (2006.01) |
| ***H04R 1/06*** | (2006.01) |
| ***H04R 3/14*** | (2006.01) |
| ***H04R 9/02*** | (2006.01) |

(52) U.S. Cl.

CPC ..... *H04R 1/24* (2013.01); *H04R 1/06* (2013.01); *H04R 3/14* (2013.01); *H04R 9/025* (2013.01); *H04R 9/06* (2013.01)

(58) Field of Classification Search

CPC ... H04R 1/24; H04R 1/06; H04R 3/14; H04R 9/025

See application file for complete search history.

(56) References Cited

U.S. PATENT DOCUMENTS

| | | | | |
|---|---|---|---|---|
| 5,548,657 | A * | 8/1996 | Fincham | H04R 1/24 381/182 |
| 6,222,929 | B1 | 4/2001 | Kim | |
| 6,393,132 | B1 | 5/2002 | Lin | |
| 2006/0093180 | A1* | 5/2006 | Kim | H04R 9/025 381/412 |
| 2009/0003632 | A1* | 1/2009 | Lin | H04R 1/24 381/182 |
| 2009/0046876 | A1* | 2/2009 | Reck | H04R 1/24 381/184 |

(Continued)

FOREIGN PATENT DOCUMENTS

| | | |
|---|---|---|
| JP | 55-138996 | 10/1980 |
| JP | 11-178082 | 7/1999 |

(Continued)

*Primary Examiner* — Simon King

(74) *Attorney, Agent, or Firm* — Nixon & Vanderhye P.C.

(57) ABSTRACT

A coaxial speaker device using a P-type speaker and an audio output device including the same are provided. The speaker device includes a first speaker configured to output a high-pitched audio, a second speaker including a P-type magnet and configured to output a low-pitched audio, and a holder configured to coaxially couple the first speaker and the second speaker. The holder includes a first protrusion configured to be coupled to a lower end of the first speaker and a second protrusion configured to be coupled to an upper end of the second speaker.

13 Claims, 13 Drawing Sheets

(56) References Cited

U.S. PATENT DOCUMENTS

| | | | | |
|---|---|---|---|---|
| 2014/0363041 | A1* | 12/2014 | Zhao | H04R 1/00 381/414 |
| 2015/0237449 | A1* | 8/2015 | Papp | H04R 7/16 381/398 |
| 2017/0111729 | A1* | 4/2017 | Robineau | H04R 1/24 |
| 2017/0134846 | A1* | 5/2017 | Kim | H04R 1/24 |

FOREIGN PATENT DOCUMENTS

| | | |
|---|---|---|
| JP | 2006-173863 | 6/2006 |
| KR | 10-0540253 | 1/2006 |

* cited by examiner

SPEAKER DEVICE AND AUDIO OUTPUT DEVICE INCLUDING THE SAME

CROSS-REFERENCE TO RELATED APPLICATION

This application is based on and claims priority under 35 U.S.C. § 119 to Korean Patent Application No. 10-2016-0146730, filed on Nov. 4, 2016, in the Korean Intellectual Property Office, the disclosure of which is incorporated by reference herein in its entirety.

BACKGROUND

Field

The present disclosure relates generally to a speaker device and an audio output device including the same, and for example, to a speaker device that a first speaker for outputting a high-pitched audio and a second speaker for outputting a low-pitched audio are coaxially located and an audio device including the same.

Description of Related Art

There are various types of speakers mounted on speaker devices, for example, a subwoofer, a woofer, a midwoofer, a squawker (midrange speaker), a tweeter, a super tweeter, and the like. In general, the speaker devices may be configured of woofers and tweeters, but other speakers may be added according to the needs of the user.

In recent years, the speaker devices may typically have the structure that woofers for low/mid frequency and tweeters for high frequency mounted on speaker devices are separately disposed. The woofers and tweeters may output a high-pitched audio and a low-pitched audio using magnets.

The magnets used for the woofers and tweeters may have an outer magnet structure (hereinafter, referred to as an F-type structure) and an inner magnet structure (hereinafter, referred to as a P-type structure). The P-type speaker devices may be a speaker that a magnet is located in the inner side of a voice coil and alnico magnets and neodymium magnets may be largely used for the magnets for the P-type speaker devices. The F-type speaker devices may be a speaker that a magnet is located in the outer side of the voice coil and ring-type ferrite magnets may be generally used for the magnets for the F-type speaker devices.

In general, an intensity of a magnet may be in proportion to an output of a speaker device and as the size of the magnet is increased, the magnetism of the magnet may be increased. Accordingly, the output in the F-type speaker devices may be increased by increasing the size of the magnet and the output in the P-type speaker devices may be increased using the magnet having a large magnetism.

Typically, the magnets used in the F-type speaker devices may be inexpensive and have the weak magnetism and thus the magnets may be used for large-sized speaker devices. The magnets used in the P-type speaker devices may be expensive and have the strong magnetism and thus the magnets may be used for small-sized speaker devices.

Positions of woofers and tweeters of speaker devices may be arbitrarily selected by the designer. The tweeters and the woofers may be often disposed separately from each other in the speaker devices of the related art. Since positions in sound sources of sounds generated in the woofers and the tweeters which are disposed in different positions are different from each other, reinforcement or interference of sound pressures may be caused. The reinforcement or interference may prevent the listeners from listening good-quality audio.

To supplement the problems, coaxial speaker devices that woofers and tweeters are coaxially arranged have been proposed. Sound sources of woofers and tweeters in the coaxial speaker devices may be located in different heights and thus it may be impossible for the coaxial speaker devices to have perfect acoustic centers.

The speaker devices having the coaxial structure in the related art may typically have the F-type structure. The F-type speaker devices may have a seat structure using the F-type magnet and it may be difficult for a wire coupled to a tweeter to be drawn out the outside of the F-type speaker device. A pole pieces and a U-shaped yoke of the tweeter in the F-type speaker device may be in contact with each other and thus a magnet inside a woofer may interfere with flow of a magnetic field in the tweeter. It may be difficult for the F-type speaker devices to be applied to thin audio output devices such as a sound bar due to the size of the F-type magnet.

SUMMARY

Example embodiments may address the above disadvantages and other disadvantages not described above.

One or more example embodiments relate to a speaker device having an accurate acoustic center using a coaxial speaker having a P-type magnet and an audio output device including the same.

One or more example embodiments relate to a speaker device having a structure wherein a wire coupled to a first speaker is drawn out from an outside of a second speaker through a holder without an effect on the second speaker and an audio device including the same.

One or more example embodiments relate to a speaker device capable of minimizing and/or reducing interference of flow of a magnetic field in a second speaker by forming a gap between a magnetic field part of a first speaker and a magnetic field part of the second speaker using a holder and an audio output device including the same.

One or more example embodiments relate to a speaker device including a race track type speaker as a second speaker and capable of ensuring sound pressure in a limited height and an audio device including the same.

According to an aspect of an example embodiment, a speaker device is provided including a first speaker configured to output a high-pitched audio; a second speaker including a P-type magnet and configured to output a low-pitched audio; and a holder configured to coaxially couple the first speaker and the second speaker. The holder may include a first protrusion configured to be coupled to a lower end of the first speaker and a second protrusion configured to be coupled to an upper end of the second speaker.

The holder may include a first hole through which a wire coupled to the first speaker is configured to pass toward a lower side of the holder. The P-type magnet may include a second hole through which the wire is configured to pass toward a lower side of the second speaker.

The first speaker may be a tweeter and the second speaker may be a woofer.

The first protrusion of the holder may include a first groove and the first groove may be coupled to a housing covering the tweeter so that the housing and the holder may be coupled to each other.

A top plate of the woofer may include a second groove and the second groove may be coupled to the second protrusion part of the holder so that the woofer and the holder may be coupled to each other.

The top plate of the holder may be formed of plastic or aluminum.

A position of a sound source output from the woofer may be the same as that of a sound source output from the tweeter.

The woofer may be a race track type woofer.

According to an aspect of an example embodiment, an audio output device is provided including a first speaker configured to output a high-pitched audio; a second speaker including a P-type magnet and configured to output a low-pitched audio; and a holder configured to coaxially couple the first speaker and the second speaker. The holder may include a first protrusion configured to be coupled to a lower end of the first speaker and a second protrusion configured to be coupled to an upper end of the second speaker. The second speaker may be a race track type speaker.

The holder may include a first hole through which a wire coupled to the first speaker is configured to pass toward a lower side of the holder. The P-type magnet may include a second hole through which the wire is configured to pass toward a lower side of the second speaker.

The first speaker may be a tweeter and the second speaker may be a woofer.

The first protrusion of the holder may include a first groove and the first groove may be coupled to a housing covering the tweeter so that the housing and the holder may be coupled to each other.

A top plate of the woofer may include a second groove and the second groove may be coupled to the second protrusion of the holder so that the woofer and the holder may be coupled to each other.

The holder may be formed of plastic or aluminum.

A position of a sound source output from the woofer may be the same as that of a sound source output from the tweeter.

According to the example embodiments, a first speaker and a second speaker in a speaker device may have a perfect or near perfect acoustic center to reduce the reinforcement or interference of sound pressure. A wire coupled to the first speaker may be easily drawn out from the outside of the speaker device using a holder and simultaneously collision between magnetic fields generated in the first speaker and the second speaker may be prevented and/or avoided through the holder.

Additional aspects and advantages of the example embodiments are set forth in the detailed description, and will be apparent from the detailed description.

BRIEF DESCRIPTION OF THE DRAWINGS

The above and/or other aspects, features and attendant advantages of the present disclosure will be more apparent and readily appreciated from the following detailed description, taken in conjunction with the accompanying drawings, in which like reference numerals refer to like elements, and wherein.

DETAILED DESCRIPTION

Figure 1:
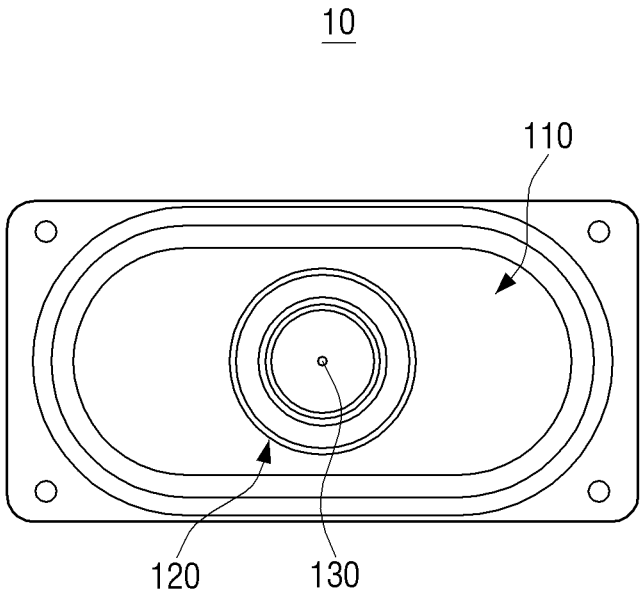
FIG. 1 is a diagram illustrating a front view of an example audio output device according to an example embodiment.

Terms used in the disclosure will be briefly described before the detailed description of the disclosure is made.

As the terminology used herein is for the purpose of describing the various example embodiments and claims, general terms which are widely used recently are selected in consideration of functions in various embodiments. It will be understood that the terms used herein may be changed depending on the intention of the technician in the art to which this inventive concept belongs, precedents, appearance of new technology, and the like. In certain cases, a portion of the terms used herein may be terms arbitrarily selected and the meaning of the selected terms should be interpreted in the detailed description of the disclosure. Accordingly, the terms used herein should not be construed as merely descriptive terms, but rather should be defined on the basis of the meaning of the terms and content in the disclosure.

Various example embodiments will now be described more fully with reference to the accompanying drawings in which some example embodiments are illustrated. The techniques described herein are example, and should not be construed as implying any particular limitation on the present disclosure. It should be understood that various alternatives, equivalents and/or modifications could be devised by those skilled in the art. In the following description, if it is determined that the gist of the disclosure may be blurred due to detailed description for the related art, the detailed description may be omitted.

It will be understood that, although the terms first, second, etc. may be used herein in reference to elements of the disclosure regardless of an order and/or importance, such elements should not be construed as limited by these terms. The terms are used only to distinguish one element from other elements.

The terminology used herein is for the purpose of describing particular embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this disclosure, specify the presence of stated features, integers, steps, operations, elements, components, and/or groups thereof, but do not preclude the presence or addition of one or more other features, integers, steps, operations, elements, components, and/or groups thereof.

The example embodiments of the disclosure will be described to be carried out by one of ordinary skilled in the art to which this disclosure belongs in detail below with reference to the accompany drawings. However, the disclosure may be implemented with various different types, but this is not limited to the example embodiments described herein. A portion of drawings which is not related to the description may be omitted to clearly describe the disclosure and in the following description, unless otherwise descried described, the same reference numerals are used for the same elements when they are depicted in different drawings.

FIG. 1 is a diagram illustrating a front view of an example audio output device 10 according to an example embodiment.

The audio output device 10 according to an example embodiment may be implemented with a sound bar, but this is merely example and the disclosure is not limited thereto. The audio output device 10 may be implemented with, for example, and without limitation, a digital television (TV), a home theater, a computer, and the like which have a speaker device. The audio output device 10 as illustrated in FIG. 1 may be thin and long as compared with the related speaker device. For example, a second speaker 110 used in the audio output device 10 may be a race track type as illustrated in FIG. 1. However, this is merely example and the second speaker 110 and a first speaker 120 may have various types, for example, and without limitation, a circular type, a race track type, and the like.

Hereinafter, an example audio output device in which the first speaker 120 is a tweeter and the second speaker 110 is a woofer will be described in the example embodiment. However, the configuration of the audio output device is not limited thereto and for example, the first speaker 120 and the second speaker 110 may be a subwoofer, a woofer, and a midwoofer. In another example, the first speaker 120 and the second speaker 110 may be a mid-range speaker such as a squawker. In another example, the first speaker 120 and the first speaker 110 may be any one of a tweeter and super tweeters.

A woofer 110 as the second speaker 110 may be a speaker configured to output a low-range sound and may typically output a sound having low frequency of a bandwidth of 40 Hz to 3 KHz.

A tweeter 120 as the first speaker 120 may be a speaker configured to output a high-range sound and may typically output a sound having high frequency of a bandwidth of 3 KHz or more.

The audio output device 10 illustrated in FIG. 1 may include a race track type woofer 110 and a circular type tweeter 120 and may be a speaker device that the race track type woofer 110 and the circular type tweeter 120 are arranged on the same axis 130. The same axis 130 may refer, for example, to a center axis of the woofer 110 that is the same as that of the tweeter 120.

The race track type woofer 110 may be characterized in that an effective area is large as compared with the circular type woofer 110. For example, the term "effective area" may refer, for example, to an area obtained by subtracting a size of a diaphragm of the tweeter 120 from a size of a diaphragm of the woofer 110.

As the effective area of the speaker is increased, the sound pressure of the speaker may be increased. The increase in the sound pressure may result in the increase in sensitivity. Accordingly, as the effective area is increased, the performance of the speaker may be improved.

In response to the effective area being increased, Mms (e.g., mechanical mass driver diaphragm assembly) due to weight of a cone (a diaphragm) may also be increased. Accordingly, the sound pressure may not be in accurate proportion to the effective area. However, the Mms increment may be larger than the increment in the effective area and thus the sound pressure may be increased.

The term "Mms" may refer, for example, to "mechanical mass of driver diaphragm assembly including air load and voice coil" and may represent the weight of a vibration system including the air resistance. The vibration system may include a cone (diaphragm), an edge, a bobbin, a voice coil, and a damper among component units of the speaker device.

Under no consideration of Mms, as the effective area is increased, the sensitivity may be increased in proportion to the effective area. For example, as illustrated in the following Table 1, in response to the effective area being doubled, the sensitivity may be increased by about 6 dB. In response to the effective area being increased three times, the sensitivity may be increased by about 9 dB.

TABLE 1

| | Effective area ($cm^2$) in the related speaker device | Effective area ($cm^2$) in coaxial speaker device |
|---|---|---|
| Tweeter 120 | X | 9.89 |
| Circular type woofer 110 | 21.65 | 11.76 |
| race track type woofer 110 | 45.56 | 35.67 |
| rate | 210% | 303% |

In Table 1, the circular type woofer 110 is a circular type woofer 110 of a 65 mm×65 mm speaker device and the race track type woofer 110 may be a race track type woofer 110 of a 120 mm×62 mm speaker device. However, Table 1 may be merely example for determining detailed values and the woofer 110 and the tweeter 120 in Table 1 may be applied to other speaker devices having various sizes.

In response to the coaxial speaker device having the race track type woofer 110 being used as illustrated in Table 1, the effective area may be further increased and thus a higher-quality audio may be provided. In response to the coaxial speaker device having the race track type woofer 110 being used, the reinforcement or interference of the sound pressure may be reduced.

In the speakers having the circular type woofer 110 and the race track type woofer 110, a difference between heights of the speakers may not be significant. However, since the size of the 120 mm×62 mm speaker device is larger than that of the 65 mm×65 mm speaker device, the woofer 110 in the 120 mm×62 mm speaker device may naturally have the larger effective area than the 65 mm×65 mm speaker device.

In the related speaker device, the increase rate in the effective area due to the race track type woofer 110 may be 210% as compared with the circular type woofer 110. However, in the coaxial speaker device, the increase rate in the effective area due to the race track type woofer 110 may be 303% as compared with the circular type woofer 110. For example, the use of the race track type woofer 110 may be more efficient in the coaxial speaker device than the related speaker device.

Figure 2A:
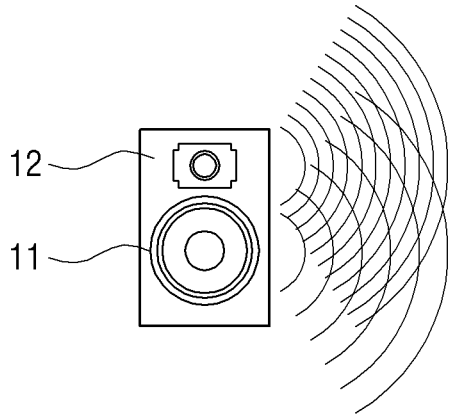
FIG. 2A (RELATED ART)
FIG. 2A is a diagram illustrating an example speaker device in which a tweeter and a woofer are separately disposed in the related art.
Figure 2B:
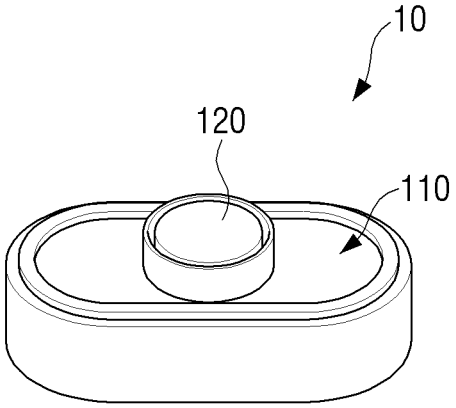
FIG. 2B is a diagram illustrating a perspective view of an example audio output device according to an example embodiment.

FIG. 2A is a diagram illustrating a speaker device that the tweeter 12 and the woofer 11 are separately disposed in the related art and FIG. 2B is a diagram illustrating a perspective view of an example audio output device 10 according to an example embodiment.

The speaker device in FIG. 2A may be a speaker device that the tweeter 12 is located in an upper side and the woofer 11 is located in a lower side. Since positions of sound sources in the speaker device are different from each other, the reinforcement or interference of a wave may be caused.

Referring to FIG. 2B, since the tweeter 120 and the woofer 110 according to an example embodiment of the present disclosure are coaxially located, the reinforcement or interference of a wave may be reduced as compared with the speaker device of FIG. 2A.

The audio output device 10 may have the configuration that the tweeter 120 and the woofer 110 are coaxially arranged and the height of the sound source generated in the tweeter 120 is the same as that of the sound source generated in the woofer 110.

In response to the height of the sound source generated in the tweeter 120 being the same as that of the sound source generated in the woofer 110, the speaker device may have a perfect or near-perfect acoustic center and thus the reinforcement or interference of the sound pressure may be further reduced.

Figure 3:
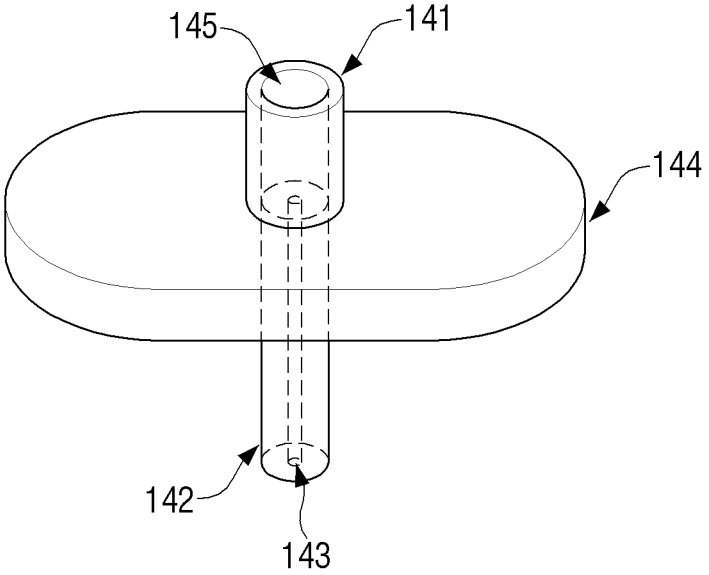
FIG. 3 is a diagram illustrating a perspective view of an example holder as an element of a speaker device according to an example embodiment.

FIG. 3 is a diagram illustrating a perspective view of an example holder 140 as an element of a speaker device according to an example embodiment.

The holder 140 may be include a first protrusion 141, a second protrusion 142, a holder hole 143 through which a wire of the tweeter 120 passes, and a holder body 144.

The first protrusion 141 may have a structure to be coupled to a rear housing which covers the tweeter 120. The first protrusion 141 may include a groove 145 in a center portion thereof as illustrated in FIG. 1. The groove 145 may be coupled to a protrusion formed in the rear housing of the tweeter 120 to couple and fix the holder 140 to the tweeter 120.

The second protrusion 142 may have a structure to be coupled to a top plate 111 (see, e.g., FIGS. 4 and 5) of the woofer 110 and may be coupled and fixed to a groove provided in the top plate 111.

It has been described in the example embodiment that the first protrusion 141 has the groove 145 and the second protrusion 142 has no groove, but the disclosure is not limited thereto. For example, the first protrusion 141 may have no groove and the second protrusion 142 may have the groove 145. In another example, both the first and second protrusion parts 141 and 142 may have the groove 145 or may have no groove.

The holder hole 143 may be a hole which is formed along the same axis 130 of the speaker device and a wire 125 coupled to the tweeter 120 passes therethrough.

It has been illustrated in the example embodiment that the holder 140, the first protrusion 141, the second protrusion 142, the holder hole 143, the holder body 144, and the groove 145 have a circular shape or an elliptical shape, but the disclosure is not limited thereto. The holder 140, the first protrusion 141, the second protrusion 142, the holder hole 143, the holder body 144, and the groove 145 may have various shapes, for example, and without limitation, a triangular shape, a quadrangular shape, and the like.

Figure 4:
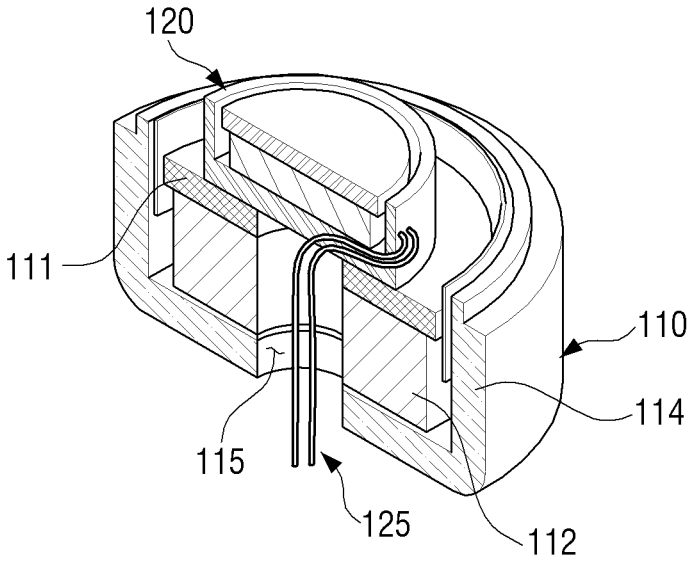
FIG. 4 is a diagram illustrating a perspective view of a cross section of an example woofer and an example tweeter according to an example embodiment.

FIG. 4 is a diagram illustrating a perspective view of a cross section of the woofer 110 and the tweeter 120 according to an example embodiment.

For example, FIG. 4 illustrates a cross section of magnetic field parts of the woofer 110 and the tweeter 120. Even in response to the woofer 110 being configured in a race track type, the P-type magnet of the woofer 110 may have a circular type. However, the P-type magnet of the woofer 110 is not limited to the circular type, but the P-type magnet of the woofer 110 may have the same race track type as the woofer 110 or may have the different type from that of the woofer 110.

It may be difficult for the wire 125 coupled to the tweeter to be drawn out from a speaker device unit in the coaxial speaker device. Accordingly, the structure that the wire is drawn out between a diaphragm of the speaker device and a connection part thereof may be provided. However, as the user uses the speaker device, the diaphragm be shaken and thus the coupling between the wire 125 of the tweeter and the diaphragm may be loosen.

A method for overcoming the problems may be provided in an example embodiment. For example, a hole 115 of a woofer may be in characterized in that the hole 115 passes through all the top plate 111, the P-type magnet 112, and a U-shaped yoke 114 of the woofer.

The hole 115 of the woofer may be a hole which is formed along the same axis 130 of the speaker device and communicates with the hole 143 of the holder 140. The wire coupled to the tweeter may pass through the hole 115 and may be drawn out toward a lower side of the speaker device.

Referring back to FIG. 3, the holder body 144 may couple the first protrusion 141 and the second protrusion 142. A gap between the tweeter 120 and the woofer 110 in the speaker device may be controlled based on a thickness of the holder body 144.

As the gap is increased, a thickness of the speaker device may be increased, but a leakage amount of magnetic field of the P-type magnet 112 in the woofer 110 may be minimized and/or reduced. A more detailed description thereof will be provided below with reference to FIGS. 6A, 6B, 6C, 7A, 7B and 7C.

Figure 5:
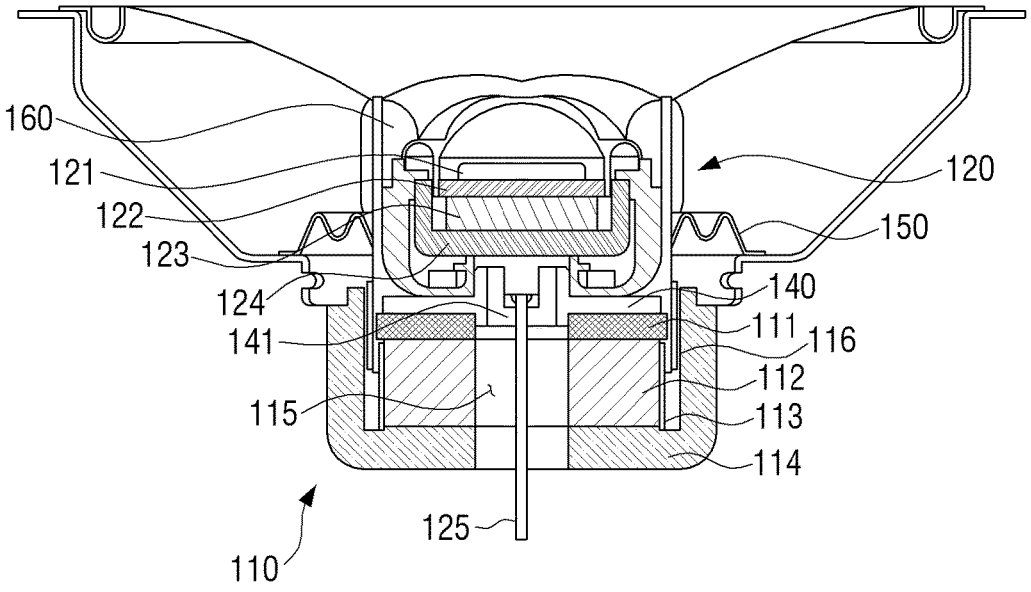
FIG. 5 is a diagram illustrating a cross section of an example speaker device according to an example embodiment.

FIG. 5 is a cross-sectional diagram illustrating an example speaker device according to an example embodiment.

The speaker device may include the woofer 110, the tweeter 120, the holder 140, a damper 150, and a wave guide 160.

For example, the woofer 110 may be configured of the top plate 111, the P-type magnet 112, a short ring 113, the U-shaped yoke 114, the woofer hole 115, and a voice coil 116.

The top plate 111 may be located over the P-type magnet 112 and may serve to fix the P-type magnet 112 together with the U-shaped yoke 114 located below the P-type magnet 112.

The top plate 111 and the U-shaped yoke 114 may be configured of a ferromagnetic metal, but the disclosure is not limited thereto. The top plate 111 and the U-shaped yoke 114 may be configured of other materials other than the ferromagnetic metal.

The P-type magnet 112 may be located in a central portion of the woofer 110 and may have a hole which the wire 125 of the tweeter 120 passes therethrough. The P-type magnet 112 may have magnetism and may serve to pull and push the voice coil 116.

As illustrated in FIG. 5, the short ring 113 may surround the P-type magnet 112. For example, the short ring 113 may be located between the outside of the P-type magnet 112 and the inside of the U-shaped yoke 114. The short ring 113 may interrupt the flow of the magnetic field and thus inductance may be improved and sound distortion may be reduced. The element such as the short ring 113 may be omitted if necessary and additional elements may be added.

The woofer hole 115 may allow the wire 125 of the tweeter which passes through the holder hole 143 to be drawn out toward the lower side of the woofer 110. For example, the woofer hole 115 may be a hole which passes through the top plate 111, the P-type magnet 112, and the U-shaped yoke 114 to the same axis 130 direction of the woofer 110.

The voice coil 116 may be a coil which surrounds the P-type magnet 112. The voice coil 116 may vertically move through the P-type magnet 112 and generate a sound together with the diaphragm. For example, in response to a direction of the magnetism generated in the voice coil 116 being the same as that of the magnetism generated in the P-type magnet 112, the diaphragm may be pushed and in response to the direction of the magnetism generated in the voice coil 116 being opposite to that of the magnetism generated in the P-type magnet 112, the diaphragm may be pulled.

However, the above-described voice coil 116 may be merely examples and may be omitted according to the kind and function of the speaker device. It will be apparent to those skilled in the art that the voice coil 116 may perform other functions in an available range.

The tweeter 120 may be include a repulsion magnet 121, a top plate 122, a main magnet 123, and a U-shaped yoke 124.

The repulsion magnet 121 may be located over the top plate 122 of the tweeter 120. The repulsion magnet 121 may be a separate magnet configured to compensate to BI which is not sufficiently obtained in the main magnet 123. The term "BI" may refer, for example, to a driving intensity in a magnetic gap and may be calculated (determined) as the product of a magnetic field B by a permanent magnet and a length I of the voice coil.

The top plate 122 may be located over the main magnet 123 and may serve to fix the main magnet 123 together with the U-shaped yoke 124 located below the main magnet 123.

The top plate 122 and the U-shaped yoke 124 may be configured of a ferromagnetic metal, but the disclosure is not limited thereto. The top plate 122 and the U-shaped yoke 124 may be configured of other materials other than the ferromagnetic metal.

The main magnet 123 may be located in a central portion of the tweeter 120. The main magnet 123 may have magnetism and may serve to pull and push the voice coil. The main magnet 123 may include a P-type magnet, but this is not limited thereto. The main magnet 123 may include an F-type magnet.

The elements of the tweeter 120, for example, the repulsion magnet 121, the top plate 122, the main magnet 123, and the U-shaped yoke 124 may be merely examples and may be omitted or changed. The tweeter 120 may be changed to any one of a squawker and tweeters.

The holder 140 may be configured of the first protrusion 141, the second protrusion 142, the holder hole 143 which a wire of the tweeter 120 passes therethrough, the holder body 144, and the groove 145 provided in the first protrusion 141.

The damper 150 may surround an edge of a diaphragm and may serve to attenuate movements of the diaphragm and the voice coil.

The wave guide 160 may determine a travelling direction of a sound and may be substituted with a horn, a phase plug, an equalizer, a diffuser, and the like.

The damper 150 and the wave guide 160 may be merely examples and the damper 150 and the wave guide 160 may be omitted or replaced with other elements if necessary.

FIGS. 6A, 6B, 6C, 7A, 7B and 7C are diagrams illustrating leakage amounts of magnetic fields in response to a gap between the tweeter 120 and the woofer 110 of the speaker device being presented and in response to the gap being not presented.

Figure 6A:
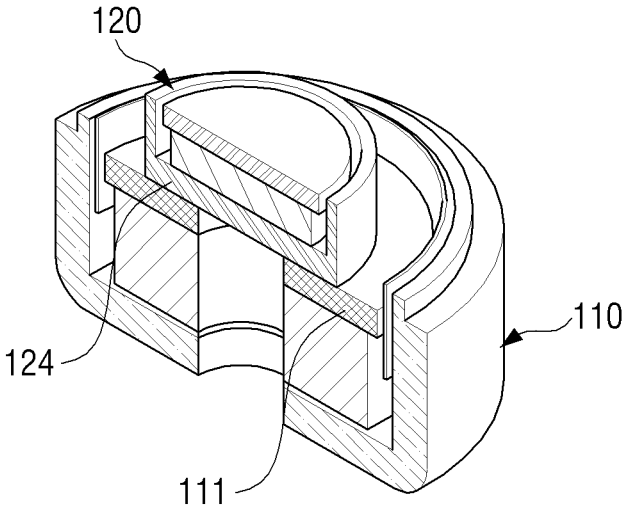
FIG. 6A is a diagram illustrating a perspective view of a cross section of an example speaker device having no gap between a tweeter and a woofer according to an example embodiment.
Figure 6B:
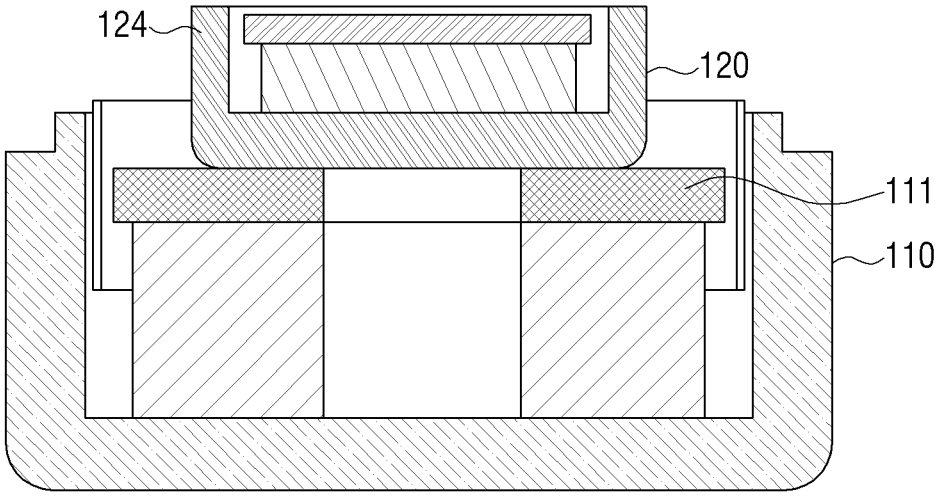
FIG. 6B is a diagram illustrating a plan view of a cross section of an example speaker device having no gap between a tweeter and a woofer according to an example embodiment.
Figure 6C:
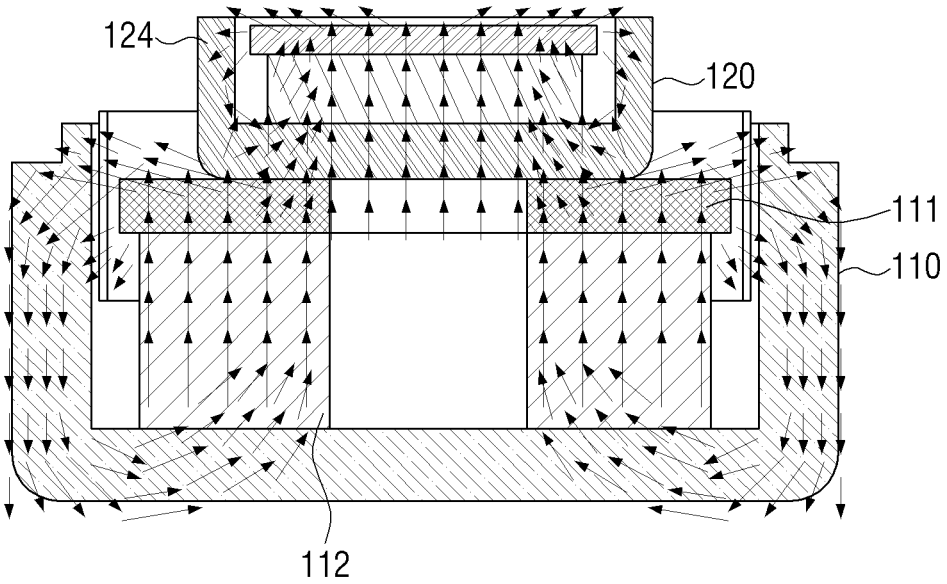
FIG. 6C is a cross-sectional diagram illustrating a leakage amount of magnetic field and a magnitude of a magnetic field in an example speaker device having no gap between a tweeter and a woofer according to an example embodiment.

For example, as illustrated in FIGS. 6A and 6B, the holder 140 may not be provided between the tweeter 120 and the woofer 110 and thus the U-shaped yoke 124 of the tweeter may be in contact with the top plate 111 of the woofer 110. It can be seen from FIG. 6C that the magnetic field generated in the P-type magnet 112 of the woofer flows into the central portion of the U-shaped yoke 124 of the tweeter. Accordingly, the magnetic fields generated in the P-type magnet 112 of the woofer and the main magnet 123 of the tweeter may collide with each other. The performance of the speaker device may be degraded due to the collision of the magnetic fields.

Figure 7A:
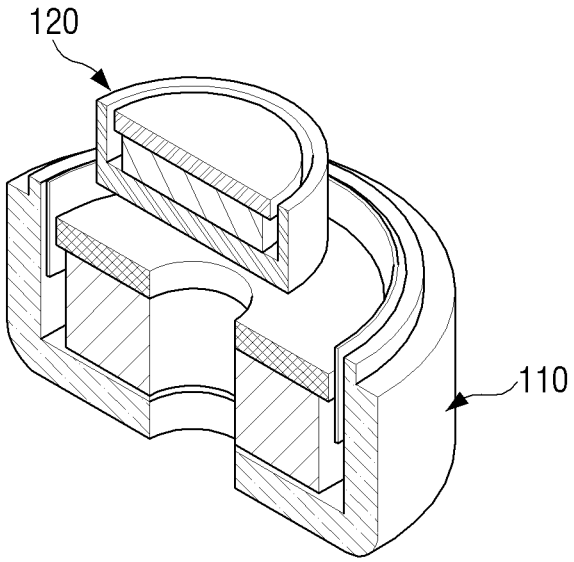
FIG. 7A is a diagram illustrating perspective view of a cross section of an example speaker device having a gap between a tweeter and a woofer according to an example embodiment.
Figure 7B:
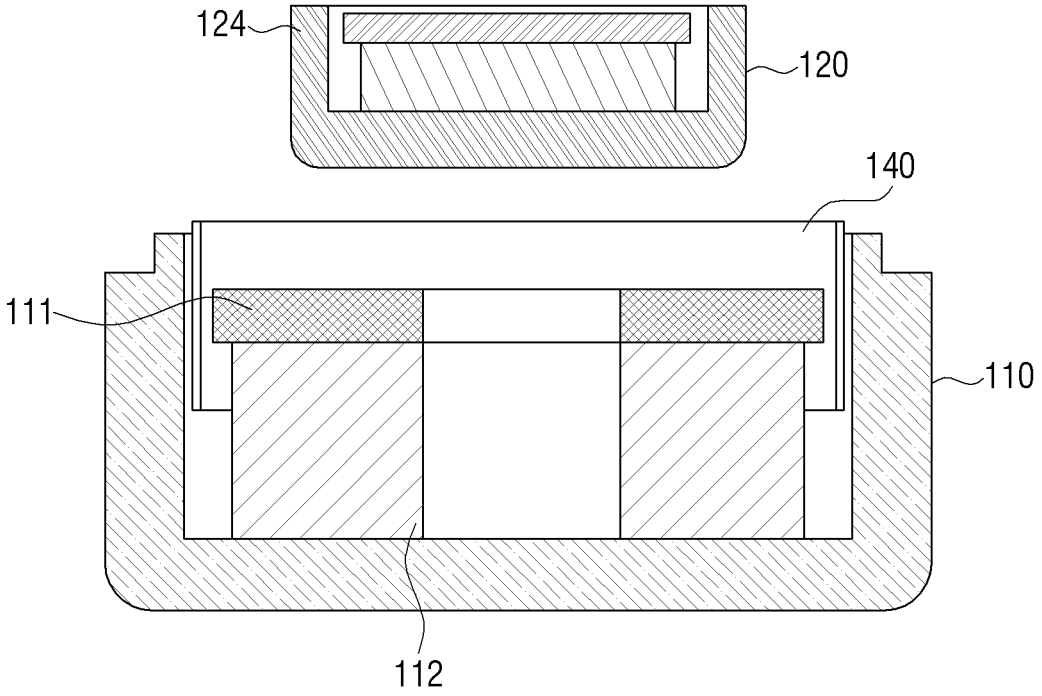
FIG. 7B is a diagram illustrating plan view of a cross section of an example speaker device having a gap between a tweeter and a woofer according to an example embodiment.
Figure 7C:
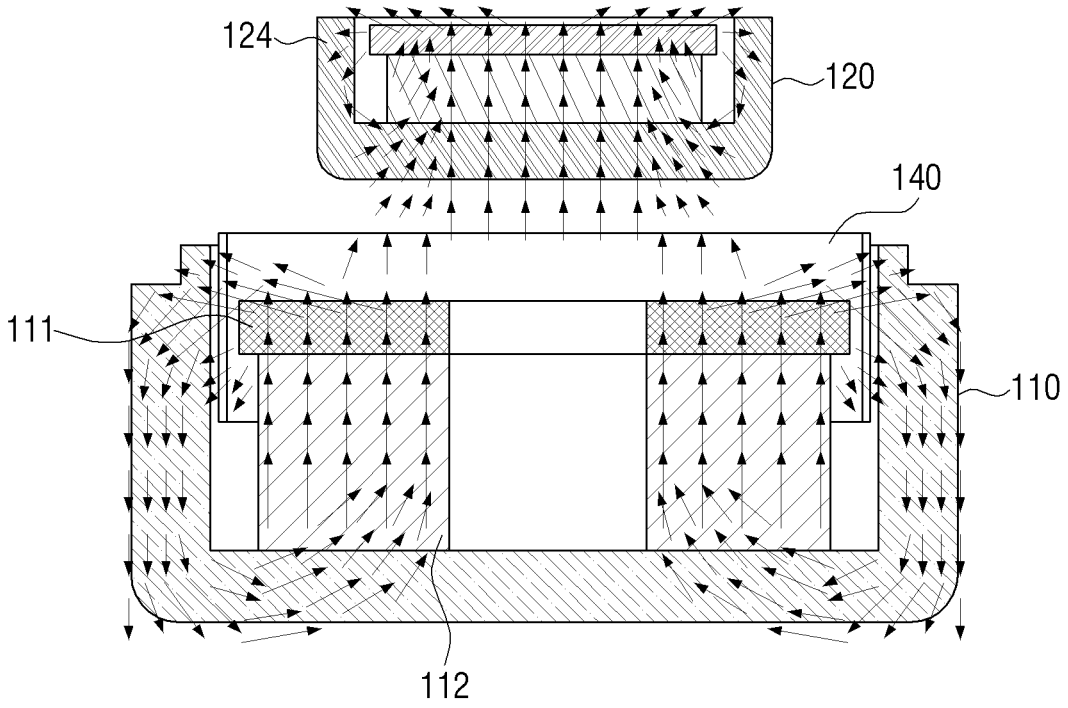
FIG. 7C is a cross-sectional diagram illustrating a leakage amount of magnetic field and a magnitude of a magnetic field in an example speaker device having a gap between a tweeter and a woofer according to an example embodiment.

As illustrated in FIGS. 7A and 7B, the holder 140 may be provided between the tweeter 120 and the woofer 110 and thus the U-shaped yoke 124 of the tweeter may not be in contact with the top plate 111 of the woofer 110. It can be seen from FIG. 7C that an amount of magnetic field which is generated in the P-type magnet 112 of the woofer and flows into the U-shaped yoke 124 of the tweeter is smaller than that of magnetic field flowing into the U-shaped yoke in FIG. 6C.

For example, the gap between the woofer 110 and the tweeter 120 may be controlled through the holder body 144. In another example, the gap between the woofer 110 and the tweeter 120 may be controlled through other units.

A material for the holder 140 may be, for example, aluminum (Al) or plastic, but this is not limited thereto. The holder 140 may be configured of other materials other than magnetic materials.

The plastic may include polyethylene terephthalate (PET), polyethylene (PE), polypropylene (PP), polystyrene (PS), polyvinyl chloride (PVC), and the like, but this is not limited thereto.

FIGS. 8A, 8B, 8C and 8D are diagrams illustrating various examples of an audio output device according to an example embodiment.

Figure 8A:
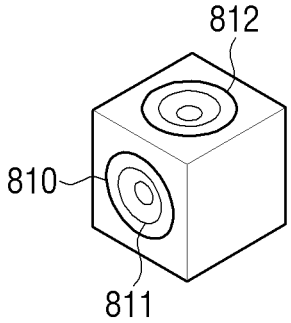
FIGS. 8A, 8B, 8C and 8D are diagrams illustrating various examples of an audio speaker device according to an example embodiment.

The audio output device 10 according to an example embodiment may be an audio output device 10 including a circular type speaker not a race track type speaker as illustrated in FIG. 8A.

As illustrated in FIG. 8A, the audio output device 10 may be a speaker device that a woofer 810 and a tweeter 811 are coaxially arranged in a front. A speaker 812 located in a top of the audio output device 10 may increase a sense of depth an output audio signal. The speaker 812 may be configured of a coaxial speaker such as coaxial speakers 810 and 811 located in the front of the audio output device 10. The coaxial speaker may be the coaxial speaker including the holder 140 according to an example embodiment. However, the speaker 812 located in the top of the audio output device 10 is not limited to the coaxial speaker and the speaker 812 may be any one of a subwoofer, a woofer, a midwoofer, a squawker, a tweeter, a super tweeter, and a full-range speaker if necessary.

Figure 8B:
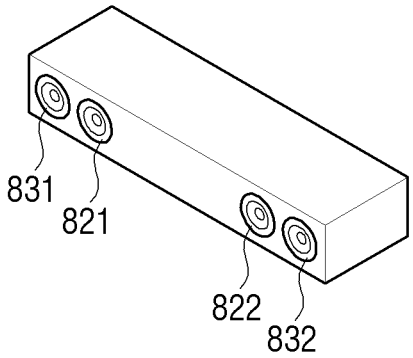

In another example, the audio output device 10 according to an example embodiment may be a speaker device as illustrated in FIG. 8B. For example, the audio output device 10 illustrated in FIG. 8B may be a sound bar.

A first speaker 821 and a second speaker 831 located in the left of the audio output device 10 and a third speaker 822 and a fourth speaker 832 located in the right of the audio output device 10 may be configured of various types of speakers.

For example, any one of speaker pairs located in the same distance from the center of the audio output device 10 may include a coaxial speaker. The coaxial speaker may be the coaxial speaker including the holder 140 according to an example embodiment. The speaker pair located in the same distance may refer to a pair of first speaker 821 and third speaker 822 or a pair of second speaker 831 and fourth speaker 832.

However, the first speaker 821, the second speaker 831, the third speaker 822, and the fourth speaker 832 of the audio speaker device 10 is not limited to the coaxial speaker and may be any one of a subwoofer, a woofer, a midwoofer, a squawker, a tweeter, a super tweeter, and a full-range speaker.

Figure 8C:
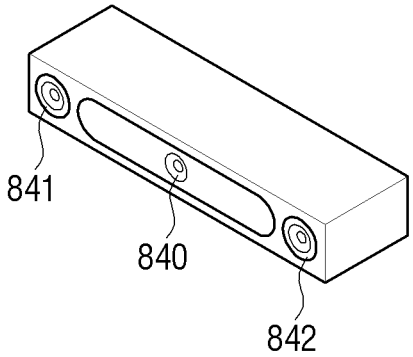

In another example, the audio output device 10 according to an example embodiment may be a speaker device as illustrated in FIG. 8C. For example, the audio output device 10 illustrated in FIG. 8C may be a sound bar.

The audio output device 10 illustrated in FIG. 8C may include a race track type coaxial speaker 840 according to an example embodiment.

A left speaker 841 located in the left of the audio output device 10 and a right speaker 842 located in the right of the audio output device 10 may be a full-range speaker. However, the left and right speakers 841 and 842 are not limited thereto and may be any one of a subwoofer, a woofer, a midwoofer, a mid-rage speaker such as a squawker, a tweeter, a super tweeter, and the coaxial speaker according to an example embodiment.

Figure 8D:
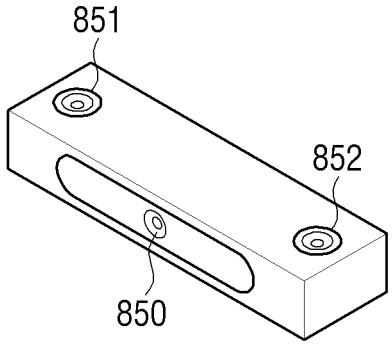

In another example, the audio output device 10 according to an example embodiment may be a speaker device as illustrated in FIG. 8D. For example, the audio output device 10 illustrated in FIG. 8D may be a sound bar.

As illustrated in FIG. 8D, the audio output device 10 may include a race track type coaxial speaker 850 in a front of the audio output device 10 and a left speaker 851 and a right speaker 852 in a top of the audio output device 10. The speaker may be located in the top of the audio output device as illustrated in FIG. 8D and thus a sense of depth of an audio signal output from the audio output device may be increased.

The left speaker 851 and the right speaker 852 in the audio output device 10 may be a full-range speaker. However, as described above, the left and right speakers 851 and 852 are not limited thereto and may be any one of a subwoofer, a woofer, a midwoofer, a squawker, a tweeter, a super tweeter, and the coaxial speaker according to an example embodiment.

However, the audio output device 10 according to an example embodiment is not limited to the audio output devices illustrated in FIG. 8. If necessary, various types of speakers may be disposed in the front and top as well as a side of the audio output device 10.

The speaker device according to an example embodiment has been described on the basis of the audio output device. However, the disclosure is not limited thereto and the speaker device according to an example embodiment may be applied, for example, to a floor standing speaker device, a bookshelf speaker device, a satellite speaker device, and the like. In another example, the speaker device according to an example embodiment may be applied to a full-range speaker device, a 2-way speaker device, a multi-way speaker device, and the like.

The foregoing example embodiments and advantages are merely examples and are not to be construed as limiting the present disclosure. The present teaching can be readily applied to other types of apparatuses. Also, the description of the example embodiments of the present disclosure is intended to be illustrative, and not to limit the scope of the claims, and many alternatives, modifications, and variations will be apparent to those skilled in the art.

What is claimed is:

1. A speaker device comprising:

a tweeter configured to output a high-pitched audio;

a woofer including a P-type magnet and configured to output a low-pitched audio; and a holder configured to coaxially couple the tweeter and the woofer, wherein the holder, disposed between the tweeter and the woofer, includes a first protrusion configured to be coupled to a lower end of the tweeter and a second protrusion configured to be coupled to an upper end of the woofer.

2. The speaker device as claimed in claim 1, wherein the holder includes a first hole through which a wire coupled to the tweeter is configured to pass toward a lower side of the holder, and the P-type magnet includes a second hole through which the wire is configured to pass toward a lower side of the woofer.

3. The speaker device as claimed in claim 1, wherein the first protrusion of the holder includes a first groove, and the first groove is coupled to a housing covering the tweeter so that the housing and the holder are coupled to each other.

4. The speaker device as claimed in claim 3, wherein a top plate of the woofer includes a second groove, and the second groove is coupled to the second protrusion of the holder so that the woofer and the holder are coupled to each other.

5. The speaker device as claimed in claim 1, wherein the holder comprises plastic or aluminum.

6. The speaker device as claimed in claim 1, wherein a sound output from the woofer has a same acoustic center as a sound output from the tweeter.

7. The speaker device as claimed in claim 6, wherein the woofer is a race track type woofer.

8. An audio output device comprising:

a tweeter configured to output a high-pitched audio;

a woofer including a P-type magnet and configured to output a low-pitched audio; and a holder configured to coaxially couple the tweeter and the woofer, wherein the holder, disposed between the tweeter and the woofer, includes a first protrusion configured to be coupled to a lower end of the tweeter and a second protrusion configured to be coupled to an upper end of the woofer, and wherein the woofer is a race track type speaker.

9. The audio output device as claimed in claim 8, wherein the holder includes a first hole through which a wire coupled to the tweeter is configured to pass toward a lower side of the holder, and the P-type magnet includes a second hole through which the wire is configured to pass toward a lower side of the woofer.

10. The audio output device as claimed in claim 8, wherein the first protrusion of the holder includes a first groove, and the first groove is coupled to a housing covering the tweeter so that the housing and the holder are coupled to each other.

11. The audio output device as claimed in claim 10, wherein a top plate of the woofer includes a second groove, and the second groove is coupled to the second protrusion of the holder so that the woofer and the holder are coupled to each other.

12. The audio output device as claimed in claim 8, wherein the holder comprises plastic or aluminum.

13. The audio output device as claimed in claim 8, wherein a sound output from the woofer has a same acoustic center as a sound output from the tweeter.

* * * * *